US008397899B2

(12) United States Patent
Krause et al.

(10) Patent No.: US 8,397,899 B2
(45) Date of Patent: Mar. 19, 2013

(54) MAIL FEEDER WITH IMPROVED STRIPPER MECHANISM

(75) Inventors: Simon Krause, Constance (DE); Rajeev Dwidedi, Plano, TX (US)

(73) Assignee: Siemens Industry, Inc., Alpharetta, GA (US)

( * ) Notice: Subject to any disclaimer, the term of this patent is extended or adjusted under 35 U.S.C. 154(b) by 286 days.

(21) Appl. No.: 12/756,559

(22) Filed: Apr. 8, 2010

(65) Prior Publication Data

US 2010/0258407 A1 Oct. 14, 2010

Related U.S. Application Data

(60) Provisional application No. 61/168,383, filed on Apr. 10, 2009.

(51) Int. Cl.
*B65G 47/06* (2006.01)
*B65G 21/20* (2006.01)

(52) U.S. Cl. ..... 198/443; 198/452; 271/12; 271/11; 271/14

(58) Field of Classification Search ..... None
See application file for complete search history.

(56) References Cited

U.S. PATENT DOCUMENTS

| | | | | |
|---|---|---|---|---|
| 3,219,339 | A | 11/1965 | Gutierrez | |
| 3,869,117 | A * | 3/1975 | Yoshimura | 271/270 |
| 6,679,491 | B2 * | 1/2004 | Luebben et al. | 271/150 |
| 2009/0206014 | A1 | 8/2009 | Enenkel | |
| 2010/0032889 | A1 | 2/2010 | Krause et al. | |
| 2010/0034623 | A1 | 2/2010 | Krause et al. | |

FOREIGN PATENT DOCUMENTS

DE 2719182 A1 11/1978

* cited by examiner

*Primary Examiner* — Kavel Singh

(57) ABSTRACT

A stripper of the invention uses flat metal springs (leaf springs) preferably made of spring steel and a flexible polymer based friction material covering the springs on one side so that the friction material contacts an incoming mail piece passing by the stripper along the friction surface presented by the outside of the friction material. A stripper according to the invention has variable stiffness, is quick responding, and is critically damped, meaning that incoming mail pieces will not bounce off it with excessive force likely to cause a misfeed or loss of control of the mail piece.

17 Claims, 5 Drawing Sheets

MAIL FEEDER WITH IMPROVED STRIPPER MECHANISM

This application claims priority of U.S. provisional application No. 61/168,383 filed Apr. 10, 2009.

FIELD OF THE INVENTION

This invention relates to mail sorting machines and methods.

BACKGROUND OF THE INVENTION

Known mail sorting systems such as DBCS and MLOCR machines include a feeder that feeds mail pieces one at a time to a pinch belt conveyor that transports singulated mail pieces during the sorting process. In one common version of such a system, a pickoff belt mechanism is positioned to frictionally engage an outer surface of a mail piece at the end of a stack and transport it transversely to a thickness direction of the stack, which pickoff mechanism includes one or more belts mounted on rollers and driven by a drive motor; a sensor positioned to determine mail piece movement speed as the mail piece is being transported by the pickoff belt mechanism; a measurement device for determining belt movement speed during operation of the pickoff belt mechanism a vacuum pump; a vacuum manifold connected to the vacuum pump, wherein the vacuum manifold is positioned to apply suction to the mail piece in a direction that tends to hold the mail piece against the belt of the pickoff belt mechanism; optionally means for stopping slipping of the mail piece relative to the belt during transport by the belt pickoff mechanism may also be provided, such as by temporarily increasing suction force applied to a mail piece being transported by the pickoff belt mechanism. Two known pickoff mechanisms are shown in U.S. Patent publications 20100034623 PICKOFF MECHANISM FOR MAIL FEEDER and 20100032889 PICKOFF MECHANISM FOR MAIL FEEDER.

A stripper is commonly provided at a position a short distance upstream from the pickoff belts. A problem arises when the pickoff belts remove two mail pieces at the same time from the stack. When such a double feed happens, a stripper is positioned a short distance upstream. See, e.g., U.S. patent publication 20090206014 to Enenkel at stripper 56. The stripper generally takes the form of a metal plate or block, that is, a friction shoe that is positioned to contact and pull off a second mail piece resting side by side with the first fed through. The second mail piece is later carried on into the pinch belt transport belts after the first one has been carried on.

The stripper plays a key role in singulation of mail on feeders. However, slow response time and improper damping of existing strippers leads to frequent doubles. The location of the friction surface is governed by the location of brackets and a bar mechanism onto which the friction shoes are mounted. The friction shoes wear over time and therefore the location of the friction surface has to be adjusted by adjusting the location of mounting brackets. Contrary to the desired dragging mode of force application on the mail pieces, known strippers apply a normal (perpendicular) load on the mail piece. In one known stripper the links used for shoe mounting are rigid hence a large point force acts on the mail and the mail is constrained at single point. The mail pieces being fed therefore can flap, bend and become damaged. The normal spring forces lead to head-on impact of the mail with the friction shoe. Large impact and corresponding displacement of the friction shoes causes lots of noise. Little attention has been paid in the art to the fabrication of the stripper and means of improving its performance. The present invention addresses these issues.

SUMMARY OF THE INVENTION

A stripper of the invention is dimensioned for use in a feeder mechanism for singulated mail pieces transported on a pinch belt conveyor. The stripper has a flexible backing sheet having an outwardly exposed friction surface for applying friction to a face of a passing mail piece, a friction shoe including a leaf spring disposed beneath the backing sheet such that external pressure against the friction surface results in resilient bending of the spring such that force is exerted outwardly against the backing by the spring. The spring preferably comprises a flat leaf spring oriented so that the leaf spring bends resiliently in response to a sufficient external pressure against the friction surface.

A mail piece feeder according to the invention comprises a pickoff mechanism including a pickoff belt mounted on rollers including a drive roller, the pickoff belt positioned to frictionally engage a mail piece at one end of a stack of mail positioned on a side edge of the mail pieces, and a stripper positioned at an exit of the pickoff belt, which stripper engages an overlying mail piece of a pair of mail pieces including an underlying mail piece and the overlying mail piece fed together in a double feed, stripping it from the underlying mail piece, wherein the stripper has a flexible backing sheet having an outwardly exposed friction surface for applying friction to a face of a passing mail piece and a friction shoe including a leaf spring disposed beneath the backing sheet such that external pressure against the friction surface results in resilient bending of the spring such that force is exerted outwardly against the backing by the spring.

These and other aspects of the invention are described further in the detailed description that follows. It is to be understood that terms used in the present invention should be given their meanings recognized in the postal sorting art, if applicable, not more general definitions found in dictionaries.

BRIEF DESCRIPTION OF THE DRAWINGS

In the accompanying drawings, where like numerals denote like elements and letters denote multiples of a component.

SUMMARY OF THE INVENTION

The present invention among other things provides a stripper which uses flat metal springs (leaf springs) preferably made of spring steel and a flexible polymer based friction material covering the springs on one side so that the friction material contacts an incoming mail piece passing by the stripper along the friction surface presented by the outside of the friction material.

A stripper according to the invention has variable stiffness, is quick responding, and is critically damped, meaning that incoming mail pieces will not bounce off it with excessive force likely to cause a misfeed or loss of control of the mail piece as has been a problem with known stripper designs.

Strippers play a key role in singulation of mail on feeders. In typical feeders used in sorters, however; slow response time and improper damping of existing strippers leads to frequent doubles. One such prior art device uses one or more friction shoes that engage passing mail pieces and is mounted on a set of coil springs. Use of coil springs in this manner renders the stripper less stable and more likely to cause a misfeed. Location of the friction surface in this device is governed by the location of brackets and bar mechanism onto which the friction shoes are mounted. The friction shoes wear over time and therefore the location of the friction surface has to be adjusted by adjusting the location of mounting brackets. Contrary to the desired dragging mode of force application on passing mail pieces, the known strippers including the foregoing spring loaded device apply a primarily "normal,": i.e. perpendicular, load on the mail. In the known stripper the links used for shoe mounting are rigid hence a large point force acts on the mail and the mail is constrained at single point. The mail therefore can flap, bend, and be damaged. The normal spring forces lead to head on impact of the mail with the stripper shoes. Large impacts of this kind and corresponding displacement of the friction shoes causes excessive noise as well as increasing the chance of a misfeed.

In view of the above drawbacks of the existing strippers, a stripper according to the invention seeks to remedy such problems. The stripper of the invention exhibits better performance than the existing stripper using coil springs as described above.

A mail piece stripper according to the invention refers to a device that is positioned or positionable downstream from a mail piece feeder that has a pickoff mechanism that removes mail pieces one at a time from the end of a stack of mail pieces, which device is effective to contact and strip away a second mail piece from a first one when the first and second mail pieces comprise a double feed by the feeder. Contact between the stripper and the second mail piece causes the second mail piece to be stripped away from the first.

These and other aspects of the invention are described more fully in the detailed description that follows.

DETAILED DESCRIPTION

Figure 1A:
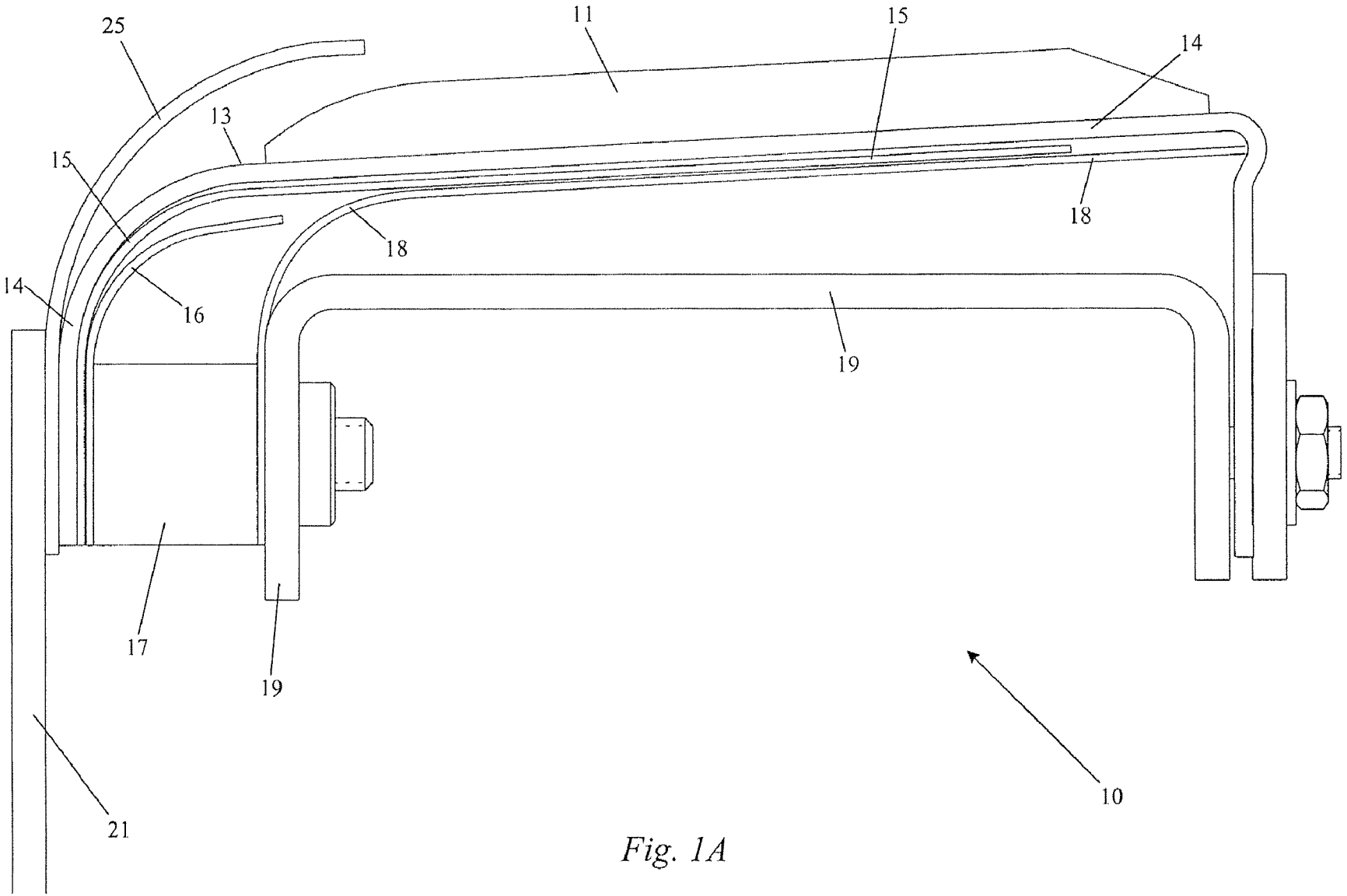
FIG. 1*a* is a top plan view of a stripper according to the invention.
Figure 1C:
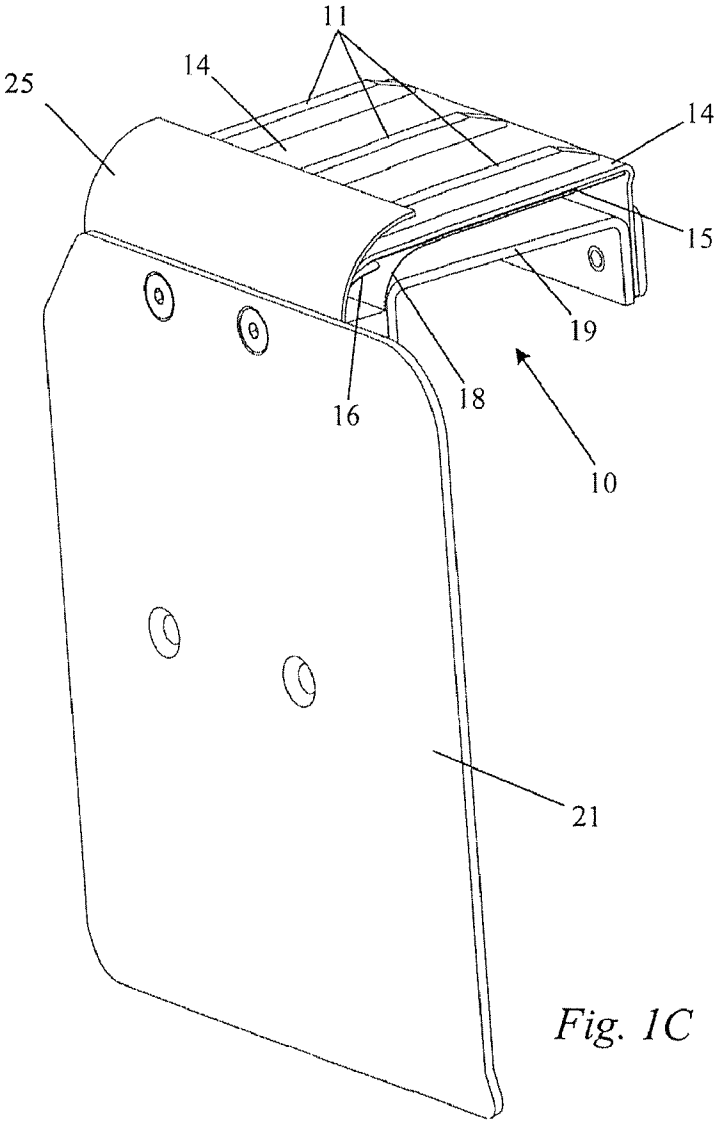
FIG. 1*c* is a second isometric side view of the stripper of FIG. 1*a;*
Figure 1B:
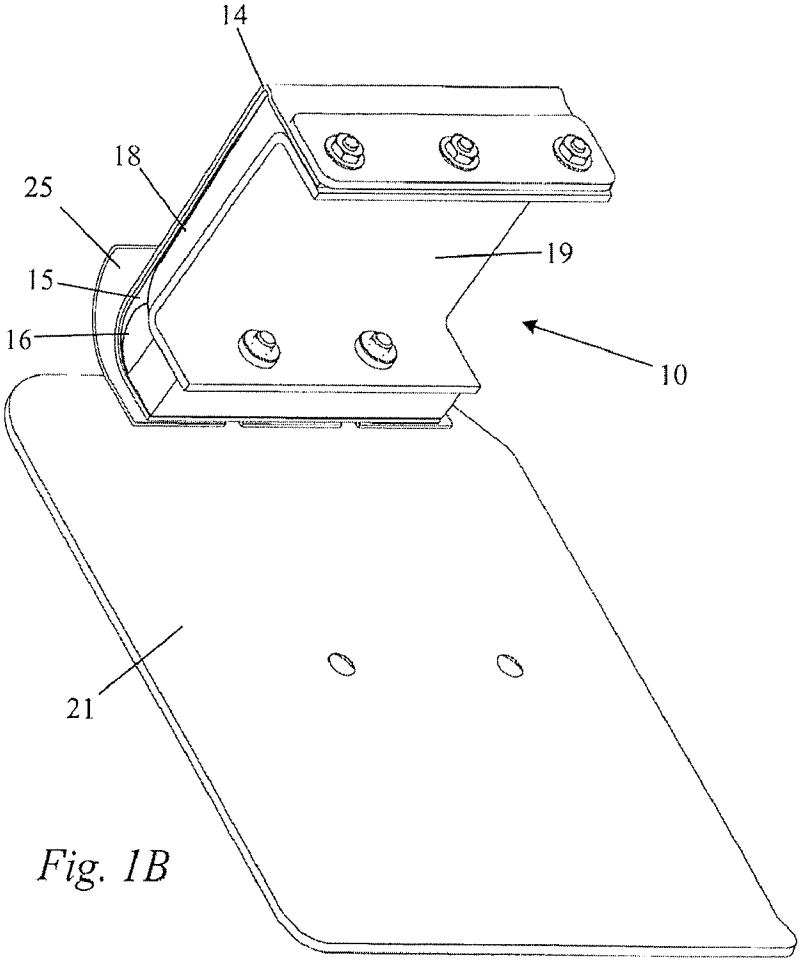
FIG. 1*b* is an isometric side view of the stripper of FIG. 1*a* according to the invention.

A stripper 10 of the invention is based on usage of the spring steel and flexible polymer based friction material arranged in laminated fashion with steel leaf springs according to the invention as described in FIGS. 1*a* to 1*c*.

Figure 2:
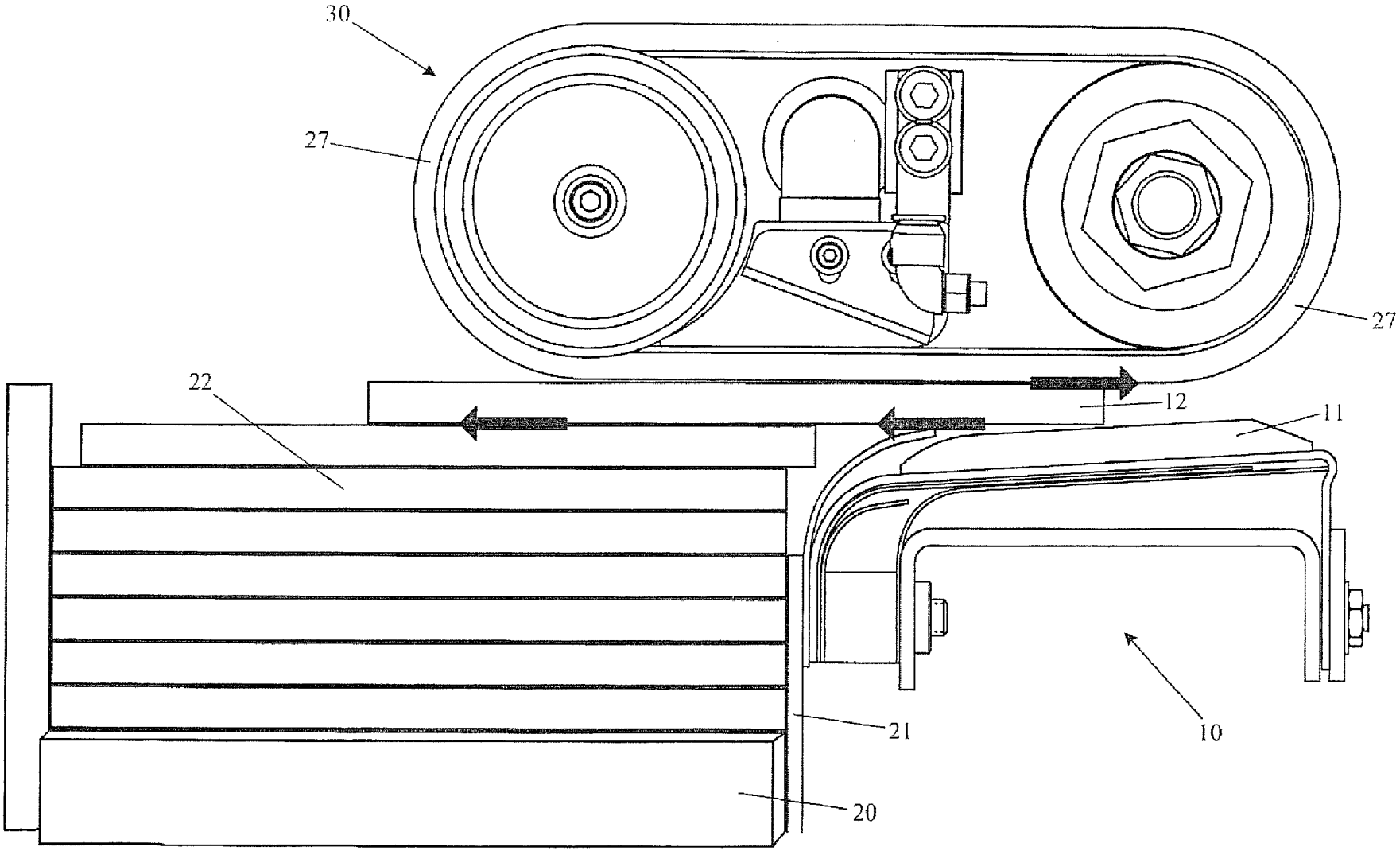
FIG. 2 is a plan view of a stripper according to the invention.

FIGS. 1*a*-1*b* show the free state of a stripper 10 of the invention, whereas FIG. 2 describes the configuration of the stripper 10 when it is mounted in the pickoff mechanism 30 of a postal processing machine such as a letter sorter provided with a feeder 20 of which pickoff mechanism 30 is part for removal of mail pieces one at a time by being drawn off sideways by pickoff 30 from a mail stack 22.

Stripper 10 in this embodiment comprises a friction shoe 11 that is positioned so that a passing mail piece 12 being conveyed by the pickoff belts 27, which may be the outer mail piece of a double (pair of mail pieces face to face fed as a double feed, slides along an outside face of shoe 11 in the direction of travel of mail pieces 12 on feeder 20 as it conveys them to a pinch belt conveyor that is part of the postal processing machine for further transport. A fence (flange) 21 is positioned to help prevent fed mail pieces 12 from coming loose from feeder 20.

As shown in FIGS. 1A, 1B and 2, the friction shoe 11 comprises resilient flat steel leaf springs 15, 16 and 18 mounted at proximal ends to a bracket 19 or a spacer 17 under a sheet of flexible backing material 14. The flexible backing material 14 is made from a flexible polymer such as a sheet of polyurethane. The outer surface 13 of backing 14 acts as a friction surface that provides a stripping action on passing mail pieces 12. The underlying springs discussed below are configured to resiliently flex when friction shoe 11 engages a mail piece 12 as shown in FIG. 2, and the springs 15, 16 and 18 press the outer friction surface 13 of backing 14 against the mail piece 12. A nylon flap 25 is positioned to aid mail pieces to move smoothly past the friction shoes 11.

The springs of each shoe 11 include a long leaf spring 15 are engaged longitudinally along the backing material 14. The long leaf spring(s) 15 provide the spring force to the friction shoe 11 in order to apply load on the mail stack 22. These springs 15 (one per shoe 11) slip on the inside surface of the polymeric backing material 14 for enabling the critical dampening of the mechanism. Another set of leaf springs 16 are shorter and stiffer than long springs 15 and are arranged longitudinally behind the long leaf springs 15. The stiff springs 16 establish point contact at the tip with the first row of springs 15. The spring 16 slips along the point of contact with spring 15 and ensures that the spring constant of the compound springs (i.e. working together against a common return force) is variable. The variability of the spring contact ensures that the forces acting on the mail pieces do not increase significantly over a starting value.

A "row" of springs according to this aspect of the invention refers to two or more springs of the same type disposed side by side as part of two or more shoes 11. In this embodiment each shoe 11 includes a set (one each) of springs 15, 16 and 18 (arranged as shown) in each of shoes 11. In this manner springs 15, 16 and 18 in each friction shoe 11 form a row of three springs which are side by side.

A set of weak springs 18 is mounted on a bracket 19 located in the rear of shoe 11. The weak springs 18 engage with the first row of springs 5 along the tips. The function of these springs 18 is to provide additional constraint and prevent flapping of the mail pieces 12 during movement past stripper 10.

Figure 3:
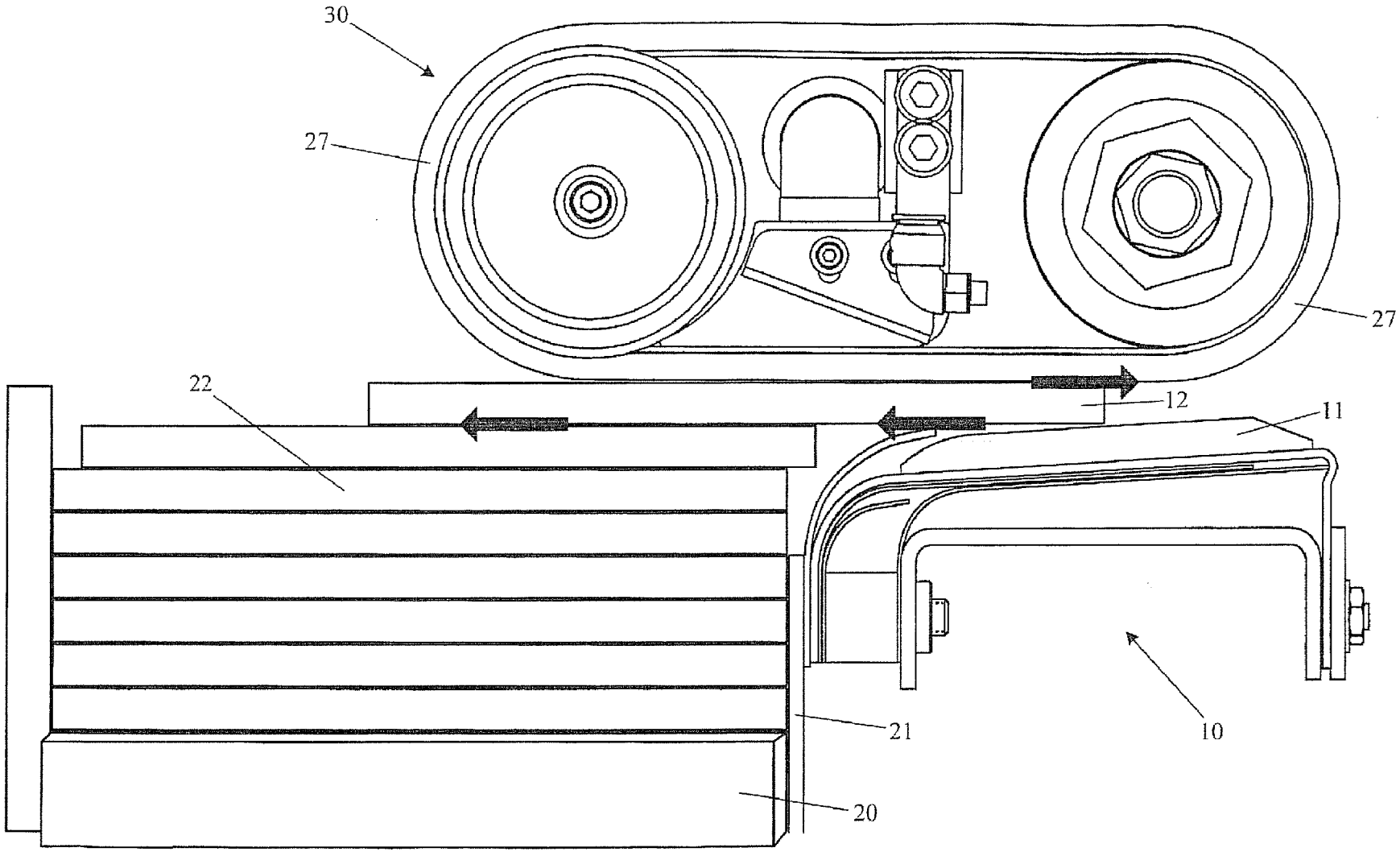
FIG. 3 is a top view of a pickoff mechanism according to the invention.

FIG. 3 shows the forces acting on a single mail piece 12 as it moves on feeder 20 and passes stripper 10. The stripping action is governed by the interplay of various forces acting along the mail piece 12. As shown in FIG. 3, the mechanical interfaces and corresponding loads offered to the mail pieces 12 include the mail-mail, mail-pickoff belt and mail-stripper shoe interfaces. Singulation of a single mail piece 12 from stack 22 at any given time is ensured by application of suitable differential frictional force. F1 is the frictional force acting on the mail along the pickoff belt-mail interface, F2 is the force acting along the mail-stripper interface and F3 is the force acting along the mail and stack interface. For the mail pieces 12 to properly go past, the stripper 10 ensures that the force F1 exceeds the cumulative F2 and F3 i.e. (F1>F2+F3).

Similarly the prevention of double feeds is ensured by the application of suitable differential forces between the mail pieces 12 when two or more mail pieces 12 get dragged into the singulation area. As shown in figure frictional force at the stripper shoe 11 mail interface should be higher than frictional force between two mail pieces. On the other hand, the frictional force between the pickoff 30 belt and mail interface should be higher than both mail-mail interface and mail-stripper shoe interface. The forces acting on the first mail piece include the frictional force from the pickoff belt and the friction force from the adjacent mail piece. The second mail piece adjacent to the first mail piece has a set of forces acting upon it. The forces acting on the second mail piece includes the pull from the first mail piece and the dragging forces from the stripper and stack respectively. In order to insure proper singulation action, the net pickoff force acting on the first mail piece must exceed the frictional force between the two mail pieces. Also, the pullback force of the stripper and stack acting on the second mail piece must exceed the dragging force coming from the first mail piece. F1 is the frictional force acting on the mail along the pickoff belt mail interface, F2 is the force acting along mail-stripper interface, F3 the force acting along the mail and stack interface and F4 the force acting along the mail-mail interface, the stripper design of the invention ensures that absolute value of F1 is larger than absolute value of F4 ($|F1|>|F4|$). Similarly, the stripper 10 also ensures that the cumulative sum of absolute values of F2 and F3 is higher than that of F4 ($|F2|+|F3>|F4|$).

Figure 4:
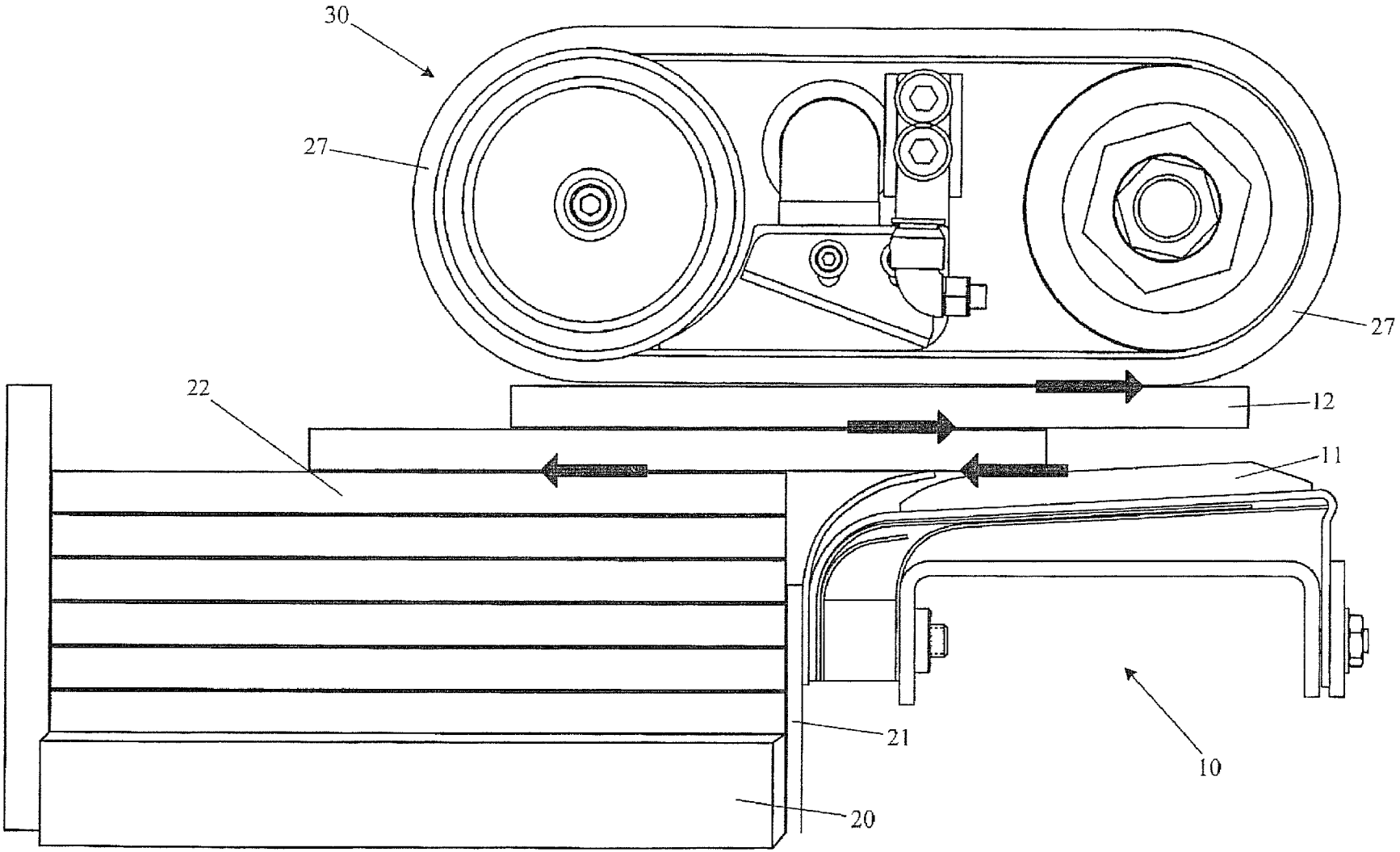
FIG. 4 is a view similar to FIG. 3 illustrating force relationships needed for singulation of mail pieces using a pickoff mechanism of the invention.

As shown in FIG. 4, frictional force at the stripper shoe-mail interface should be higher than functional force between two mail pieces. On the other hand, the frictional force between the pickoff belt and mail interface should be higher than both mail-mail interface and mail-stripper shoe interface. The forces acting on the first mail piece include the frictional force from the pickoff belt and the friction force from the adjacent mail piece. The second mail piece adjacent to the first mail piece has a set of forces acting upon it. The forces acting on the second mail piece includes the pull from the first mail piece and the dragging forces from the stripper and stack 22 respectively. In order to insure proper singulation action, the net pickoff force acting on the first mail piece must exceed the frictional force between the two mail pieces. Also, the pullback force of the stripper and stack acting on the second mail must exceed the dragging force coming from the first mail piece. For F1 being the frictional force acting on the mail along the pickoff belt-mail interface, F2 the force acting along mail-stripper interface, F3 the force acting along the mail and stack interface and F4 the force acting along the mail-mail interface, the stripper design ensures that absolute value of F1 is larger than absolute value of F4 ($|F1|>|F4|$). Similarly, the stripper also ensures that the cumulative sum of absolute values of F2 and F3 is higher than that of F4 ($|F2|+|F3|>|F4|$).

On the other hand, the frictional force between the pickoff belt and mail interface should be higher than the frictional forces at both the mail-mail interface and mail-stripper shoe interface. The mail pieces that are fed have wide range of geometric and physical properties. For a consistent performance of the stripper, the invention ensures that the performance of the stripper is independent of the physical properties of the mail.

The laminated arrangement of the springs and backing material ensure that the friction surface is flexible and therefore establishes a constant engagement of the mail and friction surface along every point of the mail in the entry region. This attribute of the stripper design ensures that the entry of the mail into pickoff 30 is conformal and all the degrees of freedom of the mail are arrested. The mail therefore does not flap sideways and is confined along the conformal entry established by the flexible friction surface. Also the dominating stiffness of the spring material will prevent the formation of local bending of friction material and hence trapping/flapping/bending of the mail.

Wherever required there are a set of multiple springs arranged in rows laminated format, that is, covered by plastic backing 14. The multiple springs are free to move relative to each other. This attribute allows the spring to have variable spring stiffness and therefore the loads acting on the mail are independent of the geometry of the mail. The slipping of the springs allows spring force to be sustained within allowable limits. On the contrary if the springs are not allowed to have relative motion with respect to each other, the force will increase with the bending and engagement of more springs.

The friction material is arranged in a laminated fashion so that the relative motion of the spring and shoe allows critical dampening. The critical dampening will enable quick settling of the stripper and therefore increase the availability of the stripper interface.

The laminated arrangement of the springs and flexible backing material is held towards the rear regions of the shoe 11 and bend along normal direction so that a conformal wedge shaped entry region is created. This wedge shaped entry region ensures that the entry of the mails is smooth and there is no head on impact between the entering mail piece 12 and stripper 10. Also, the pattern of bending ensures that the forces acting on the mail are lateral drag forces.

These include the frictional force from the pickoff belt and the friction force from the adjacent mail piece. The second mail piece adjacent to the first mail piece has a set of forces acting upon it. The forces acting on the second mail piece includes the pull from the first mail piece 12 and the dragging forces from the stripper 10 and stack respectively. In order to insure proper singulation action, the net pickoff force acting on the first mail piece must exceed the frictional force between the two mail pieces. Also the pullback force of the stripper and stack 22 acting on the second mail must exceed the dragging force coming from the first mail piece. Let F1 be the frictional force acting on the mail along the pickoff belt-mail interface, F2 the force acting along mail-stripper interface, F3 the force acting along the mail and stack interface and F4 the force acting along the mail-mail interface, the stripper 10 ensures that absolute value of F1 is larger than absolute value of F4 ($|F1|>|F4|$). Similarly, the stripper 10 also ensures that the cumulative sum of absolute values of F2 and F3 is higher than that of F4 ($|F2j+|F3|>|F4|$).

In the foregoing manner the stripper of the present invention can be configured in a manner that operates smoothly and rapidly with the problems with excessive noise and misfeeds which characterize the prior art stripper using coil springs. If noise is not an issue, it is also possible to use small coil springs in place of the leaf springs described above, but leaf springs have been shown to provide superior performance as compared to devices using coiled compression springs.

Although several embodiments of the present invention have been described in the foregoing detailed description and illustrated in the accompanying drawings, it will be understood by those skilled in the art that the invention is not limited to the embodiments disclosed but is capable of numerous rearrangements, substitutions and modifications without departing from the spirit of the invention. Such modifications are within the scope of the invention as expressed in the appended claims.

The invention claimed is:

1. A mail piece feeder comprising:

a pickoff mechanism including a pickoff belt mounted on rollers including a drive roller, the pickoff belt positioned to frictionally engage a mail piece at one end of a stack of mail positioned on a side edge of the mail pieces; and a stripper positioned at an exit of the pickoff belt, the stripper configured to engage an overlying mail piece of a pair of mail pieces including an underlying mail piece and the overlying mail piece fed together in a double feed so that the overlying mail piece is separated from the underlying mail piece, wherein the stripper is dimensioned for use in the pickoff feeder mechanism for singulated mail pieces transported on a pinch belt conveyor, the stripper including a flexible backing sheet, a friction shoe attached to the backing sheet and positioned to engage the overlying mail piece, and a plurality of leaf springs of different lengths and stiffnesses disposed beneath the backing sheet such that external pressure against the friction shoe results in resilient bending of at least one of the leaf spring such that force is exerted outwardly against the backing by the at least one leaf spring.

2. The mail piece feeder of claim 1, wherein the at least one leaf spring is oriented to cause a frictional force between the friction shoe and the overlying mail piece that is greater than a frictional force between the overlying mail piece and the underlying mail piece.

3. The mail piece feeder of claim 1, wherein the plurality of leaf springs includes a row of three springs.

4. The mail piece feeder of claim 1, wherein the stripper also includes a nylon flap positioned to enable a plurality of mail pieces to move smoothly past the friction shoe.

5. The mail piece feeder of claim 1, wherein the flexible backing sheet is made from a flexible polymer.

6. A mail piece feeder comprising:

a pickoff mechanism configured to frictionally engage a mail piece at one end of a stack of mail; and a stripper positioned at an exit of the pickoff belt and configured to engage a first mail piece of a pair of mail pieces, including a second mail piece and the first mail piece fed together in a double feed, so that the first mail piece is separated from the second mail piece, the stripper including a flexible backing sheet, a friction shoe attached to the backing sheet and positioned to engage the first mail piece, and a plurality of leaf springs of different lengths and stiffnesses positioned to bias the friction shoe against the first mail piece, wherein external pressure against the friction shoe results in resilient bending of at least one of the leaf spring.

7. The mail piece feeder of claim 6, wherein the at least one leaf spring is oriented to cause a frictional force between the friction shoe and the first mail piece that is greater than a frictional force between the first mail piece and the second mail piece.

8. The mail piece feeder of claim 6, wherein the plurality of leaf springs includes a row of three springs.

9. The mail piece feeder of claim 6, wherein the stripper also includes a nylon flap positioned to enable a plurality of mail pieces to move smoothly past the friction shoe.

10. The mail piece feeder of claim 6, wherein flexible backing sheet is made from a flexible polymer.

11. The mail piece feeder of claim 6, wherein the at least one leaf spring is made of spring steel.

12. A mail piece feeder comprising:

a pickoff mechanism configured to frictionally engage a mail piece at one end of a stack of mail; and a stripper positioned at an exit of the pickoff belt and configured to engage a first mail piece of a pair of mail pieces, including a second mail piece and the first mail piece fed together in a double feed, so that the first mail piece is separated from the second mail piece, the stripper including a flexible backing sheet, a friction shoe attached to the backing sheet and positioned to engage the first mail piece, and at least one leaf spring positioned to bias the friction shoe against the first mail piece, wherein the at least one leaf spring is critically damped, wherein external pressure against the friction shoe results in resilient bending of the critically damped at least one leaf spring, wherein the at least one leaf spring includes a plurality of leaf springs of different lengths and stiffnesses.

13. The mail piece feeder of claim 12, wherein the critically damped at least one leaf spring is oriented to cause a frictional force between the friction shoe and the first mail piece that is greater than a frictional force between the first mail piece and the second mail piece.

14. The mail piece feeder of claim 12, wherein the critically damped at least one leaf spring includes a row of three springs.

15. The mail piece feeder of claim 12, wherein the stripper also includes a nylon flap positioned to enable a plurality of mail pieces to move smoothly past the friction shoe.

16. The mail piece feeder of claim 12, wherein the flexible backing sheet is made from a flexible polymer.

17. The mail piece feeder of claim 12, wherein the critically damped at least one leaf spring is made of spring steel.

* * * * *